United States Patent [19]

Merriman

[11] 4,196,514

[45] Apr. 8, 1980

[54] NAIL CLIPPER WITH ELASTOMER CLIPPING RETAINER

[76] Inventor: Henry H. Merriman, 751 W. Washington, Jackson, Mich. 49203

[21] Appl. No.: 935,167

[22] Filed: Aug. 21, 1978

[51] Int. Cl.[2] ..... B26B 17/04

[52] U.S. Cl. ..... 30/28; 30/124

[58] Field of Search ..... 132/25.5; 30/28, 29, 30/124

[56] References Cited

U.S. PATENT DOCUMENTS

| | | | |
|---|---|---|---|
| 2,960,766 | 11/1960 | Whittle | 30/28 |
| 2,985,957 | 5/1961 | Freedman | 30/28 |
| 4,062,109 | 12/1977 | Min | 30/28 |
| 4,117,591 | 10/1978 | Terry | 30/28 |

*Primary Examiner*—Jay N. Eskovitz

*Attorney, Agent, or Firm*—Beaman & Beaman

[57] ABSTRACT

A fingernail or toenail clipper utilizing an expandable elastomer intermediate leaf spring members upon which the cutting edges are defined wherein the elastomer expands against the cutting edges during nail clipping to retain the severed nail clipping against the cutting edges until the edges are opened. Additionally, as the elastomer is mounted adjacent the cutting edges it may serve as a gauge to locate the nail relative to the cutting edges prior to severing.

3 Claims, 5 Drawing Figures

NAIL CLIPPER WITH ELASTOMER CLIPPING RETAINER

SUMMARY OF THE INVENTION

The invention pertains to finger and toenail clipping apparatus capable of severing and retaining nail clippings within the cutting apparatus until release is desired.

Nail clippers utilizing a pair of leaf spring elements interconnected at one end and having cutting edges defined at the other end are well known wherein a fulcrum post is mounted upon one of the members adjacent a cutting edge and extends through the other member for support of a fulcrum lever utilized to displace the cutting edges relative to each other, and produce cutting. Such nail manicuring apparatus is very common and is manufactured in large quantities by a number of manufacturers, and while such apparatus adequately severs and cuts clippings, disposal of the clippings is often a problem in that the clippings fall from the cutter, or are projected therefrom with significant velocity in many cases, and such uncontrolled dispersing of the clippings is untidy and often objectionable.

Various nail clipping retainers have been developed for use with spring member nail clippers such as shown in U.S. Pat. Nos. 2,887,773, 3,013,334 and 3,188,737, and in my U.S. Pat. No. 3,918,156 I have disclosed the encasing of the clipper apparatus in such a manner as to confine and retain severed nail clippings.

It is an object of the present invention to provide a very simple means for retaining the nail clippings severed by clippers utilizing spring members and a fulcrum lever, and in the practice of the invention only slight modification of existing apparatus is necessary.

A further object of the invention is to provide a nail clipping retainer for nail clippers which is economical, requires no unusual skills or knowledge on the part of the clipper user, and which permits the nail clippers to be retained by the clipper as desired, and yet permits ready release of the clippings.

Yet another object of the invention is to provide a nail retainer for nail clippers which also functions as a gauge to help prevent excessive nail removal and which is capable of positioning the finger relative to the clipper prior to severing.

In the practice of the invention a conventional nail clipper is utilized consisting a pair of leaf spring members interconnected at one end and have cutting edges defined adjacent the other end. The cutting edges are positioned relative to each other by a lever mounted on a fulcrum post affixed to one of the spring members adjacent the cutting edges and extending through the other spring member for the support of the fulcrum lever. Pivoting of the lever relative to the post compresses the adjacent spring member to bring the cutting edges into engagement to produce the cutting action.

In the practice of the invention an elastomer member is interposed between the spring members about the fulcrum post and adjacent the inside surfaces of the cutting edges. The elastomer engages the inside surfaces of the spring members, and is compressed as the cutting edges are moved toward each other. The dimension and location of the elastomer is such that during the final stages of cutting the elastomer will expand against the nail clipping being severed and hold the severed clipping against the inside surfaces of the cutting edges as long as the spring members are maintained in their "closed" relationship and the cutting edges are in engagement. Thus, as long as the user holds the clipper in the "closed" condition the severed nail clipping will be retained within the configuration of the spring members, and upon release or opening of the lever the elastomer will release the severed nail clipping permitting disposal as desired.

The elastomer, which preferably, is of a tubular configuration and circumscribes the fulcrum post, includes an exterior surface which will be located adjacent and inwardly of the cutting edges. Upon inserting the fingernail between the cutting edges the nail will engage the elastomer surface if the fingernail is inserted an excessive degree beyond the cutting edges. Thus, the elastomer functions as a depth gauge or stop and aids in preventing cutting the nail too "deep".

BRIEF DESCRIPTION OF THE DRAWINGS

The aforementioned obejcts and advantages of the invention will be appreciated from the following description and accompanying drawings wherein.

DESCRIPTION OF THE PREFERRED EMBODIMENT

Figure 1:
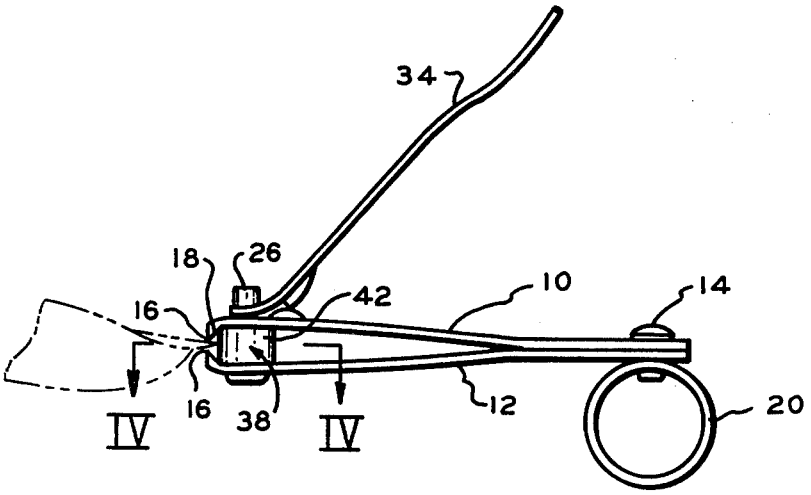
FIG. 1 is a side elevational view of a nail clipper in accord with the invention illustrating a fingernail inserted between the open cutting edges.

A nail clipper utilizing the invention is of a conventional construction employing a pair of leaf spring members 10 and 12 interconnected at one end, the right end, FIG. 1, by welding or a rivet 14. The other end of the spring members are each provided with ground cutting edges 16 which are usually of a concave configuration in a fingernail clipper, and are often formed of a slight convex configuration in a toenail clipper. The cutting edges each include an interior surface 18, FIG. 3, against which the severed nail clipping is held, as will be later described.

In the disclosed embodiment a ring 20 is shown as affixed to the rivet 14 for improving the handling characteristics of the clipper, and the ring 20 is disclosed in greater detail in my co-pending U.S. Application Ser. No. 848,239 and constitutes no part of the present invention.

Figure 3:
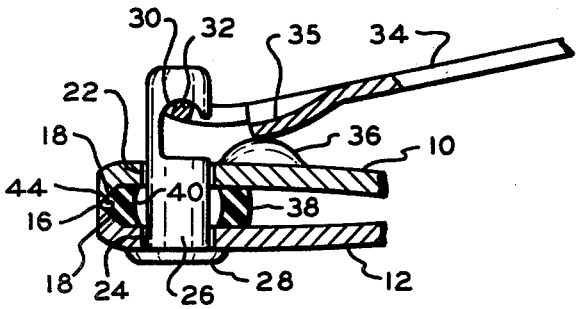
FIG. 3 is an enlarged, elevational, detail cross sectional view illustrating the relationship of the components after severing a nail clipping and prior to release thereof.

As will be appreciated from FIG. 3, spring member 10 is provided with an opening 22 adjacent its cutting edge 16, and spring member 12 is provided with hole 24 in alignment with hole 22. A fulcrum post 26 extends through the holes 24 and 22 and on its lower side is provided with a head 28 for bearing against lower spring member 12, and the upper end of the fulcrum post includes a open notch 30 for receiving fulcrum lever portion 32 in the known manner. The fulcrum lever 34 includes a handle portion, and a boss 35 adapted to engage the boss 36 which may be formed in the upper spring member 10 adjacent the opening 22.

Figure 2:
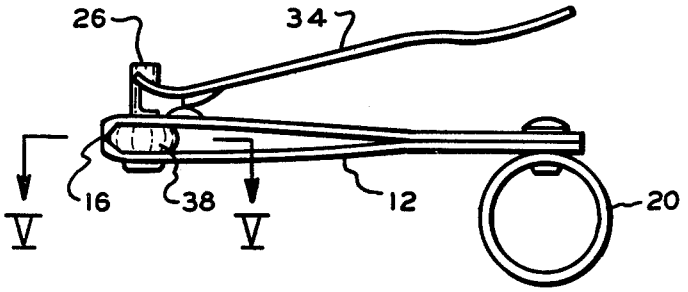
FIG. 2 is a side elevational view illustrating the relationship of the clipper components upon the cutting edges engaging, and upon completion of cutting.
Figure 4:
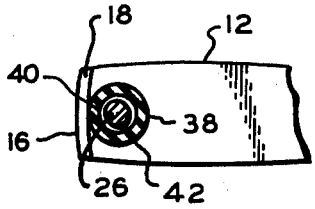
FIG. 4 is a plan sectional view as taken along Section IV—IV of FIG. 1 illustrating the elastomer in the non-compressed condition.

Thus, in the known manner movement of the lever 34 from the position of FIG. 1 to the position of FIG. 2 will close the cutting edges 16 to sever a nail located between the cutting edges, and the lever may be rotated relative to the spring members to lie substantially close to the spring member 10 during clipper storage.

A tubular elastomer element 38 circumscribes the post 26 intermediate the leaf springs 10 and 12. The element 38 is provided with an internal bore 40 which will usually be slightly greater in diameter than the post diameter, and the element includes a cylindrical outer surface 42 in the normal noncompressed condition.

The axial length of the elastomer element 38 is preferably substantially equal to the separation of the elements 10 and 12 at the post wherein the uncompressed configuration of the elastomer will exist when the spring members are separated their maximum extent as shown in FIG. 1. Upon closing of the spring members 10 and 12 by operation of the lever 34 the spring members will compressed the elastomer 38 causing the elastomer to radially outwardly distend to a bulbous convex configuration as will be appreciated from FIGS. 2 and 3.

Figure 5:
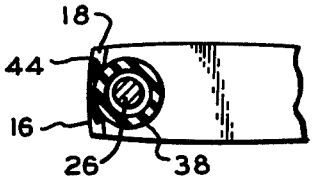
FIG. 5 is a plan sectional view taken along Section V—V of FIG. 2 illustrating the elastomer in the compressed condition.

The wall thickness of elastomer 38, and its dimensions relative to the clipper are such that when the cutting edges 16 are in engagement as to sever a nail clipping the elastomer will be tightly forced against the cutting edge surfaces 18 as apparent in FIGS. 3 and 5. This relationship causes the elastomer to engage and tightly hold the severed nail clipping 44 against the cutting edges inner surfaces 18 as apparent in FIG. 3, and, thus, the severed nail clipping 44 will not fall from the clipper, but be firmly retained therein as long as the lever 34 is depressed and the cutting edges 16 maintained in engagement. The dimensions of the elastomer are such that the expansion of the elastomer which occurs as the cutting edges are brought toward each other is not sufficient to push the nail away from the post and cutting edges during clipping unless the nail is inserted into the cutting edges an excessive degree. As will be apparent from FIG. 1, the nail to be trimmed, if sufficiently long, will engage the outer surface 42 of the elastomer wherein the elastomer will function as a nail gauge or stop to prevent an excessive insertion of the nail into the clipper helping to prevent harm to the finger, and the presence of the elastomer does not detract from the use of the clipper in the normal manner except with respect to the release of the severed nail clipping.

After the nail clipping 44 has been severed the user will normally hold the lever 34 in the closed position, locate the clipper over a wastebasket or other receptacle, permit the lever to pivot to the open position and thereby release the clipping from the clipper. In this manner the elastomer 38 prevents the clippings from dropping from the clipper or projecting from the cutting edges.

As the elastomer is located intermediate the spring members its presence in no way adds to the bulk or size of the clipper and does not affect the handling thereof. Furthermore, as the elastomer is centrally located with respect to the length of the cutting edges 16 the elastomer does not interfere with the use of the ends of the cutting edges as is often required when accurately trimming. Sheath type nail clipper retainers may intefere with the use of the ends of the cutting edges if the sheath is located too close to the cutting edge ends.

It will be appreciated that various modifications to the inventive concept may be apparent to those skilled in the art without departing from the spirit and scope of the invention.

I claim:

1. A fingernail clipper characterized by its ability to retain nail clippings including a pair of elongated spring leaf members interconnected at a first end and each formed with a cutting edge at a second end, said cutting edges being in opposed nipping relationship, a fulcrum post mounted to one of said members adjacent said second end thereof and extending through an opening defined in the other member adjacent its second end and a lever mounted on said post engageable with said other member for selectively positioning said cutting edges relative to each other, the improvement comprising an elastomer element interposed between said spring members at the second end thereof adjacent the member cutting edges and circumscribing the fulcrum post, said elastomer element compressing and expanding upon the cutting edges being displaced toward each other whereby said expanding element will retain severed nail clippings against the member's cutting edges during engagement of the cutting edges.

2. In a fingernail clipper as in claim 1 wherein said elastomer element comprises a tubular member.

3. In a fingernail clipper as in claim 2 wherein said tubular elastomer member is of a normal uncompressed cylindrical exterior configuration.

* * * * *